US007775051B2

(12) United States Patent
Hernandez et al.

(10) Patent No.: US 7,775,051 B2
(45) Date of Patent: Aug. 17, 2010

(54) ARRANGEMENT FOR A JET ENGINE COMBUSTION CHAMBER

(75) Inventors: Didier Hippolyte Hernandez, Quiers (FR); Thomas Olivier Marie Noel, Vincennes (FR)

(73) Assignee: SNECMA, Paris (FR)

( * ) Notice: Subject to any disclaimer, the term of this patent is extended or adjusted under 35 U.S.C. 154(b) by 605 days.

(21) Appl. No.: 11/678,896

(22) Filed: Feb. 26, 2007

(65) Prior Publication Data

US 2007/0199329 A1 Aug. 30, 2007

(30) Foreign Application Priority Data

Feb. 27, 2006 (FR) ..... 06 01695

(51) Int. Cl.
*F02C 7/20* (2006.01)

(52) U.S. Cl. ..... 60/796; 60/798; 60/748; 60/752; 60/800; 60/804

(58) Field of Classification Search ..... 60/796, 60/748, 752, 798, 800, 804
See application file for complete search history.

(56) References Cited

U.S. PATENT DOCUMENTS 3,742,704 A 7/1973 Adelizzi
7,478,534 B2 * 1/2009 Guezengar et al. ..... 60/796

FOREIGN PATENT DOCUMENTS

EP 0 373 984 A1 6/1990
EP 0 476 927 A2 3/1992

* cited by examiner

*Primary Examiner*—Michael Cuff
*Assistant Examiner*—Craig Kim
(74) *Attorney, Agent, or Firm*—Oblon, Spivak, McClelland, Maier & Neustadt, L.L.P.

(57) ABSTRACT

The combustion chamber includes a chamber endwall perforated by at least one passage hole. An injection system is mounted so that it can slide diametrically with respect to the passage hole. A deflector is mounted on the chamber endwall. The deflector includes a fitting ring which includes first tenons. A sleeve which is coaxial to the fitting ring includes second tenons. The first and the second tenons allow the passage of the first tenons between the second tenons and then the engagement of the first tenons behind the second tenons. The injection system is slidably mounted in the sleeve. Anti-rotation means are provided to prevent a rotation of the injection system with respect to the sleeve.

12 Claims, 5 Drawing Sheets

ARRANGEMENT FOR A JET ENGINE COMBUSTION CHAMBER

TECHNICAL FIELD

Background of the Invention and Description of the Prior Art

The invention relates to an arrangement for a jet engine combustion chamber, said chamber comprising a chamber endwall perforated by at least one circular passage hole, the arrangement comprising an injection system associated with said at least one passage hole and mounted so that it can slide diametrically with respect to the circular passage hole in the chamber endwall, and a deflector mounted fixedly on a chamber endwall inside the combustion chamber.

The combustion chambers of jet engines comprise an inner wall and an outer wall connected at their upstream ends by an annular endwall so as to define an annular combustion chamber endwall. Injection systems distributed regularly over the periphery of the endwall of the combustion chamber deliver an air/fuel mixture which is ignited to supply combustion gases.

The fuel is supplied to the injection system by an injector mounted on an outer casing wall and of which the head is centered on the injection system. Furthermore, a deflector protects the chamber endwall from the flames of the combustion chamber. However, there are differential expansions between the combustion chamber and the casing. It is therefore necessary to provide a mechanism to compensate for this differential expansion.

In a first type of arrangement (see, for example, document EP 1 290 378) the head of the injector is centered on a sliding feedthrough which can move radially with respect to the injection system so as to compensate for the differential expansion of the combustion chamber with respect to the casing.

However, there are injector heads which, apart from a central nozzle, comprise peripheral nozzles which discharge into a secondary swirler or external swirler of the injection system. In this case, it is not admissible to allow a deflection of the injector head with respect to the injection system, since the injector head must be permanently centered with respect to the injection system. It is thus necessary to compensate for the differential expansions by sliding the injection system with respect to the chamber endwall. The invention is concerned with an arrangement of this type.

Moreover, according to another imperative, in the event of a fracture of one of the brazed joints used to assemble the constitutent parts of the arrangement, it is necessary that no part can become detached and strike the combustion chamber and the downstream portion of the engine, especially the HP turbine, a situation which might result in an engine explosion.

SUMMARY OF THE INVENTION

The subject of the invention is precisely an arrangement for a jet engine combustion chamber which makes it possible to achieve these objectives. Firstly, this arrangement must allow the injection system to slide with respect to the chamber endwall. Secondly, it must be designed in such a way that none of the parts is able to leave in the downstream direction in the event of a fracture of a brazed joint.

These aims are achieved, according to the invention, through the fact that the deflector comprises a fitting ring bearing first tenons which are spaced circumferentially and project radially, and in that the arrangement comprises a sleeve which is coaxial to the fitting ring of the deflector and bears second tenons which are spaced circumferentially and project radially, the first and the second tenons being sufficiently spaced to allow the passage of the first tenons between the second tenons and then, through a rotation, the engagement of the first tenons behind the second tenons in such a way as to prohibit the deflector and the sleeve from separating in an axial direction, the injection system being slidably mounted in the sleeve, antirotation means being provided to prevent a rotation of the injection system with respect to the sleeve.

By virtue of these features, differential expansions of the casing with respect to the combustion chamber are compensated for at the chamber endwall, and none of the parts is able to strike the combustion chamber or the turbine in the event of a fracture of a brazed joint.

In one particular embodiment, the injection system comprises a floating ring slidably mounted in the sleeve.

In another particular embodiment, the sleeve takes the form of a cup having an end seat on which the floating ring can slide and a rim, the sliding ring being retained by a closure ring welded to the rim.

Advantageously, the fitting ring passes through the passage hole in the chamber endwall.

Preferably, the first tenons are directed radially outward and the second tenons are directed radially inward.

Advantageously, the antirotation means which prohibit a rotation of the injection system with respect to the sleeve are formed by a tongue for the orientation of the floating ring and by a slot formed in the rim of the sleeve, the orientation tongue being introduced into the slot.

In a preferred embodiment, the arrangement comprises an orientation finger which passes through the chamber endwall and which engages, at one end, into a slot for the orientation of the deflector and, at another end, into a slot for the orientation of the sleeve, this orientation finger imposing a defined angular orientation of the deflector and of the sleeve with respect to the chamber endwall and, therefore, a defined angular orientation of the sleeve and of the deflector with respect to one another.

Preferably, the floating ring is provided with a multitude of ventilation holes passing through it.

Preferably again, the ventilation holes in the floating ring are arranged in such a way that they are opposite the deflector in a region where there is a clearance between the injection system and the deflector that is below a limit value and are disengaged from the deflector in a region where the clearance between the injection system and the deflector is above this limit value.

Moreover, the invention relates to a jet engine comprising an arrangement according to the invention, and also to a sleeve, an injection system and a deflector forming part of the arrangement.

BRIEF DESCRIPTION OF THE DRAWINGS

Other features and advantages of the invention will become apparent on reading the description below of exemplary embodiments given by way of illustration with reference to the appended figures. In these figures.

DESCRIPTION OF THE PREFERRED EMBODIMENTS

Figure 1:
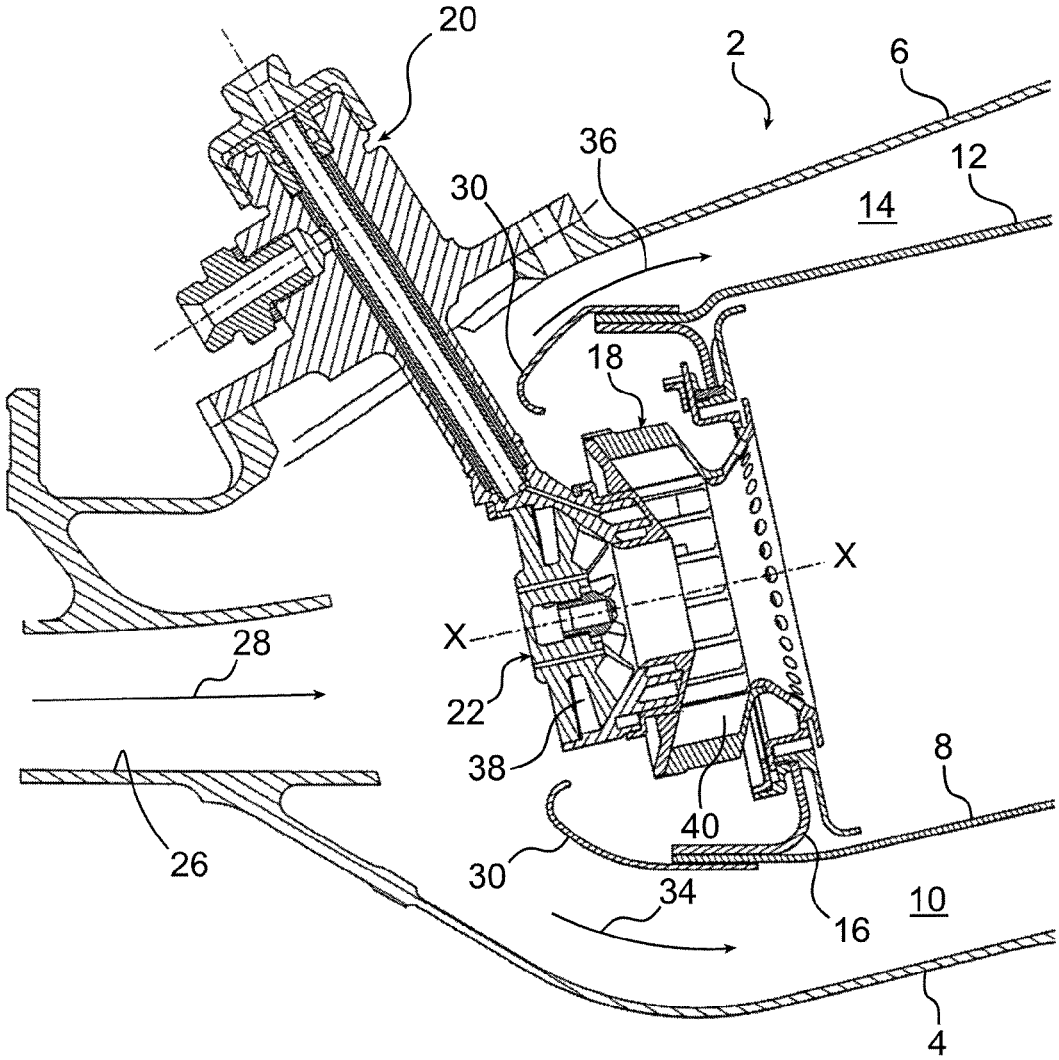
FIG. 1 is a general view of a combustion chamber comprising an arrangement according to the invention.

FIG. 1 shows a partial schematic sectional view of a jet engine combustion chamber denoted by the general reference 2 comprising an arrangement according to the present invention. The combustion chamber 2 has a shape with longitudinal symmetry of revolution with respect to a general axis of the turbine (not shown). It comprises an inner casing wall 4 and an outer casing wall 6. An inner chamber wall 8 delimits a passage 10 with the inner casing wall 4, and an outer chamber wall 12 delimits a passage 14 with the outer casing wall 6.

The inner chamber wall 8 and outer chamber wall 12 are connected by a chamber endwall 16 at their upstream ends. A plurality of injection systems 18, for example from 14 to 22, with a regular angular spacing (only one injection system has been shown in FIG. 1) are provided on the chamber endwall 16. For each injection system 18 an injector 20 is mounted on the outer casing wall 6. The injector comprises an injector head 22 centered on the injection system 18 of axis XX.

The way in which the combustion chamber module operates is as follows. The pressurized air from the compressor enters the combustion chamber through the passage 26, as depicted by the arrow 28. Some of the air passes through the central opening in the cowl 30, while the remainder of the air stream is directed via the outside of the cowl toward the passages 10 and 14, as depicted by the arrows 34 and 36. Openings (not shown) are provided in the inner wall 8 and outer wall 12 of the combustion chamber to allow air to enter from the passages 10 and 14.

The air which enters the cowl 30 is rotated in the primary swirler 38 of the injector head 22 and in the secondary swirler 40 of the injection system 18. It mixes with the fuel delivered by the injector head 22. The gaseous mixture enters the combustion chamber, in which it is ignited.

Figure 2:
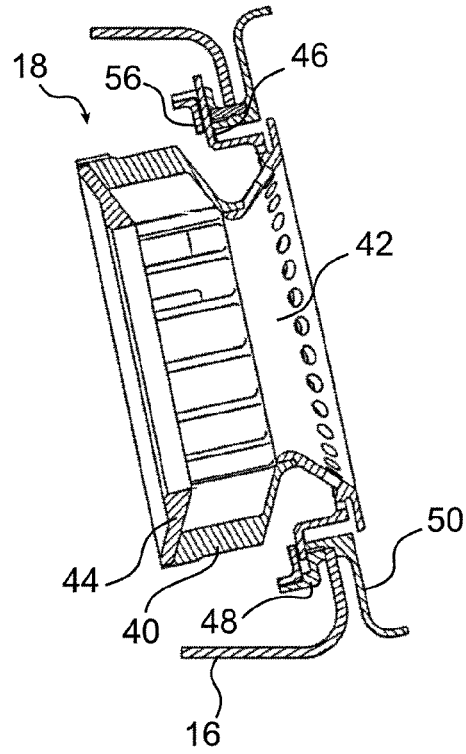
FIG. 2 is a detail view of the injection system forming part of the arrangement of FIG. 1.

FIG. 2 shows a detail view of the injection system 18. It consists of a bowl 42, of the aforementioned secondary swirler or external swirler 40, and of the centering ring 44. The latter is designated thus because it enables the injector head 22 to be centered with respect to the injection system 18. The injection system 18 is slidably mounted with respect to the chamber endwall 16 by way of a floating ring 46 which is formed in a single piece with the bowl 42 and which slides in a sleeve 48 secured to the chamber endwall 16.

The deflector 50 protects the chamber endwall 16 from the flames of the combustion chamber.

Figure 3:
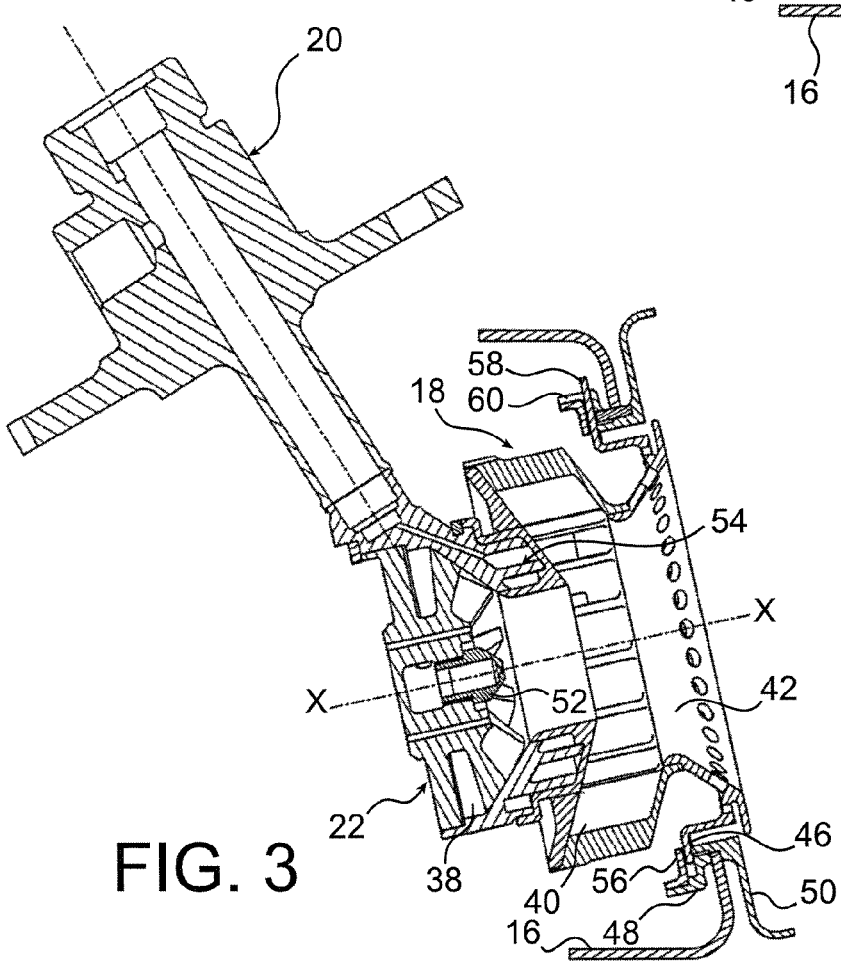
FIG. 3 is a sectional view of the injector head mounted on the injection system of the invention.

FIG. 3 is a view on an enlarged scale of the injector head 22 mounted on the injection system 18. As explained above, the injector head 22 comprises a central nozzle 52 and peripheral injection points 54 which discharge into the secondary swirler 40. It is thus necessary for the injector head 22 to be permanently and perfectly centered with respect to the injection system 18. This is the reason why it cannot be slidably mounted with respect to the injection system, as is the practice in some arrangements. The injector head is thus centered on the centering ring 44 of the injection system 18 and it is the assembly consisting of the injector head and the injection system that is slidably mounted with respect to the chamber endwall 16 in the sleeve 48. To this end, the floating ring 46 secured to the bowl 42 is slidably mounted in the sleeve 48 closed by the closure ring 56. Antirotation means are provided to prevent a rotation of the injection system with respect to the sleeve 48. In the exemplary embodiment described, these means consist of a tongue 58 which forms part of the floating ring 46 and which is inserted into a slot 60 formed in a rim of the sleeve.

Consequently, the injection system is able to move radially with respect to the deflector 50 and with respect to the chamber endwall 16. In FIG. 3, the injection system has been shown in the centered position, it being understood, however, that the injection system can move between a first off-centered position in which the clearance at one of the ends, for example the inner end, is zero, and a second off-centered position in which the clearance at the other end is zero.

Figure 4:
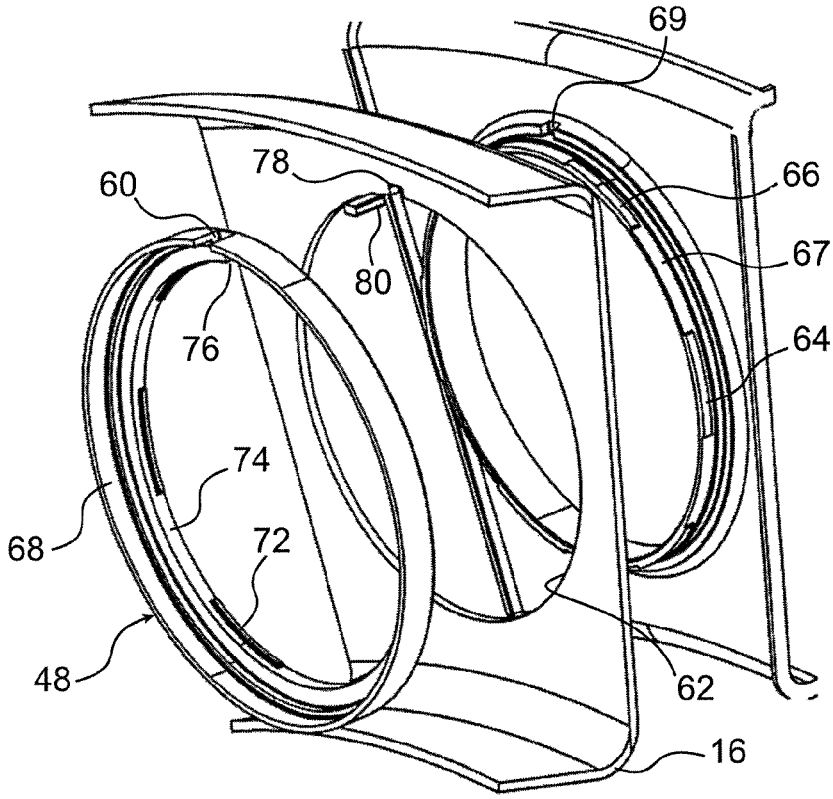
FIG. 4 is an exploded view showing the mounting of the sleeve on the deflector.

The deflector 50 is mounted fixedly on the chamber endwall 16 inside the combustion chamber. FIG. 4 shows a preferred embodiment of the fixing of the deflector on the chamber endwall. The chamber endwall 16 comprises a circular passage hole 62. The deflector 50 comprises a fitting ring 64 which engages into the passage hole 62. The fitting ring comprises regularly distributed tenons 66, for example six in the exemplary embodiment represented. The sleeve 48 takes the form of a cup having an end seat on which the floating ring can slide and a rim 68 in which there is formed a slot 60 for accommodating the tongue 58 of the floating ring 46.

The tenons 66 alternate with slots 67. In the example represented, the length of the tenons 66 is equal to that of the slots 67. In other words, given the fact that there are six tenons and six slots in the example, each tenon and each slot extends over an angle at the center of 15°. Finally, the deflector 50 comprises an orientation slot 69.

Similarly to what has been described in relation to the fitting ring 64, the sleeve 48 comprises six tenons 72 with a regular angular distribution alternating with six slots 74 whose length is equal to that of the tenons in the example represented. In other words, as in the case of the fitting ring 64, each of the tenons 72 and each of the slots 74 extends over an angle at the center of 15°. The sleeve 48 also comprises an orientation slot 76. Moreover, an orientation slot 78 is formed in the circular passage hole 62 of the chamber endwall 16.

The deflector 50 is mounted on the chamber endwall 16 in the following way. First of all, the fitting ring 64 of the deflector 50 is introduced into the circular passage hole 62 such that the tenons 66 protrude with respect to the chamber endwall 16. Next, starting from the position represented in FIG. 4, in which the slots 69 for the orientation of the deflector 50, the slot 76 for the orientation of the sleeve 48 and the slot 78 for the orientation of the chamber endwall 16 are aligned, the sleeve 48 is rotated in one or other direction by a fraction of a turn such that the tenons 72 of the sleeve 48 are situated opposite slots 67 of the fitting ring 64. In the example described, it is thus required to rotate the sleeve 48 through an angle of 15° in the clockwise direction or in the counterclockwise direction. The sleeve is then engaged onto the fitting ring of the deflector, the tenons 72 of the sleeve 48 passing between the tenons 66 of the fitting ring 64. With the sleeve having been fully engaged, it is rotated by a fraction of a turn in the opposite direction to the preceding direction such that the three orientation slots are once more aligned. An orientation finger 80 is then inserted into the three slots 76, 78 and 69 so as to immobilize these three parts in a relative position with respect to one another. With a correct angular orientation being guaranteed by the insertion of the orientation finger 80, it is then possible to start brazing the assembly. It will be understood that even in the event of a fracture of the brazed joint, the deflector 50 will be retained by these tenons 66 engaged behind the tenons 72 of the sleeve 48. Thus, even in the event of a defective brazed joint, the deflector cannot be sucked into the combustion chamber, according to one of the essential features of the invention.

Figure 5:
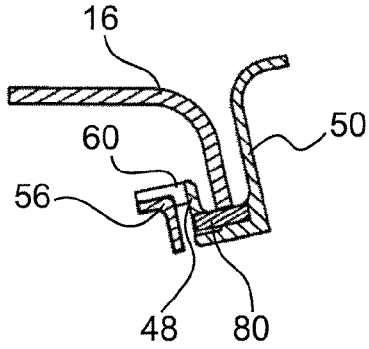
FIG. 5 is a detail view of a finger for the orientation of the sleeve and the deflector with respect to the chamber endwall.

FIG. 5 represents a detail view showing the insertion of the orientation finger 80 into the slots for the respective orientation of the sleeve 48, the chamber endwall 16 and the deflector 50.

Figure 6:
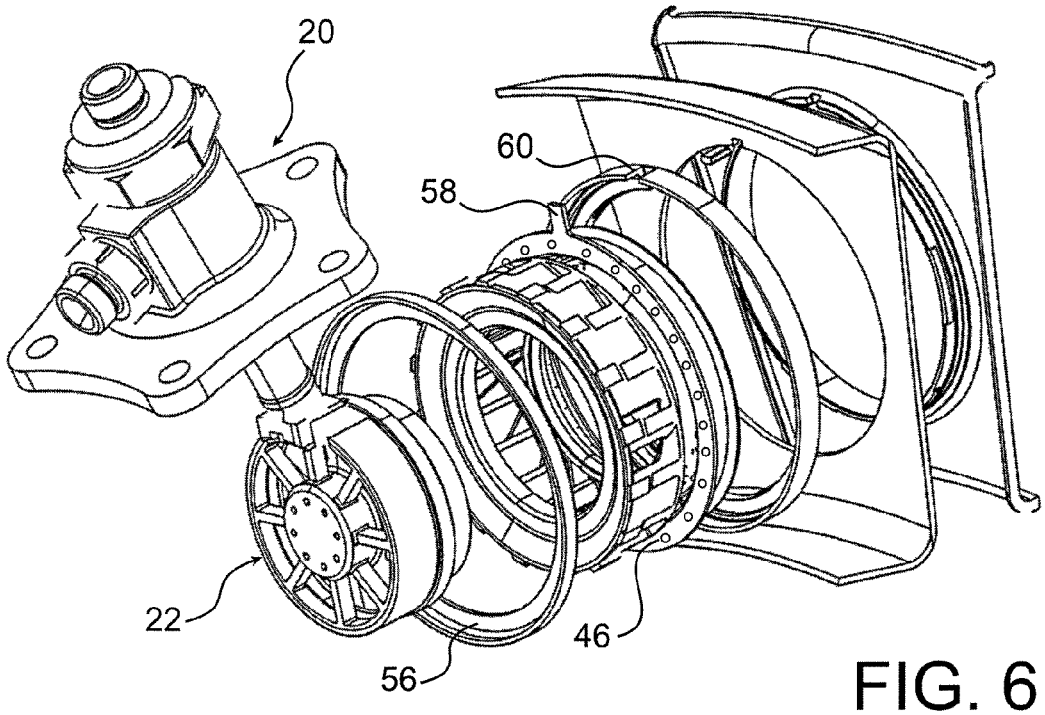
FIG. 6 is an exploded perspective view of the arrangement of the invention.
Figure 7:
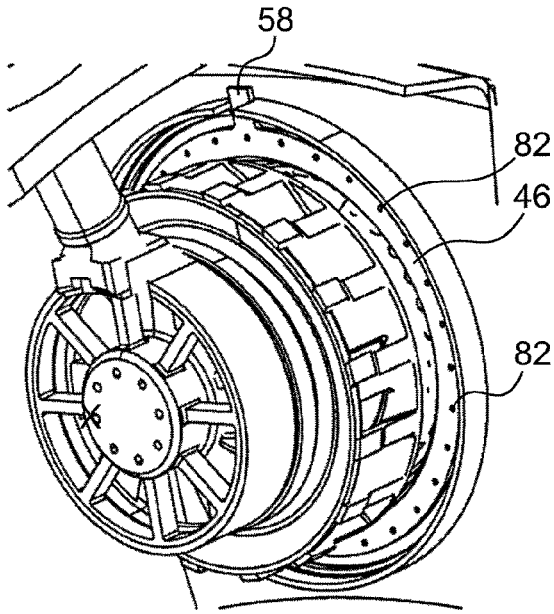
FIG. 7 is an assembled perspective view of the arrangement of the invention.

FIG. 6 represents an exploded perspective view of the deflector, the chamber endwall 16, the sleeve 48, the injection system 18, the closure ring 56 and the injector 20 with its injection head 22. In FIG. 7, these various parts have been represented in the assembled position.

The mounting operation takes place in the following way. With the deflector having been mounted fixedly on the chamber endwall 16, and brazed in this position as has been explained above, the floating ring 46 of the injection system 18 is introduced into the sleeve 48, the orientation tongue 58 being introduced into the slot 60 of the sleeve 48. The closure ring is then introduced into the sleeve and is welded in this position by means of three or four circumferentially distributed welding beads. Consequently, it is easy to replace the injection system if necessary. For that purpose it is required merely to grind the welding beads and to remove the closure ring and then the injection system.

With the injection system being retained by the closure ring, said system can slide freely in a radial direction within the limit of the clearance between the bowl and the sleeve 48. The head 22 of the injector is then introduced into the centering ring of the injection system.

Figure 10:
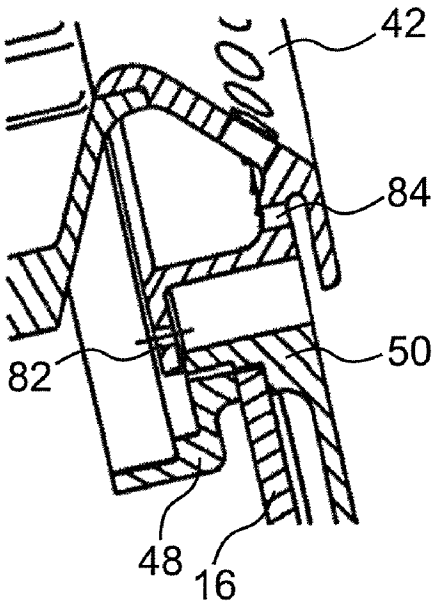
FIGS. 8 to 10 are three detail views which show the operation of the ventilation holes in the floating ring.
Figure 9:
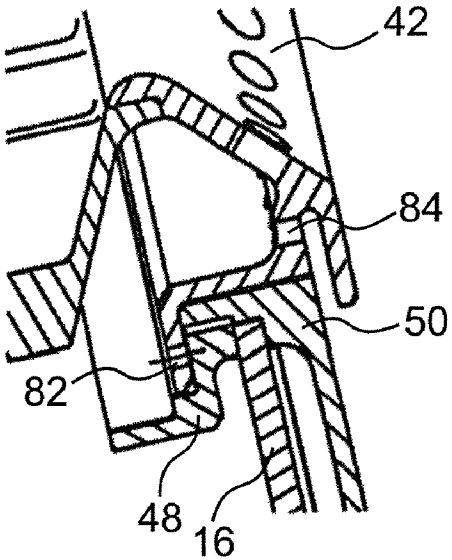
Figure 8:
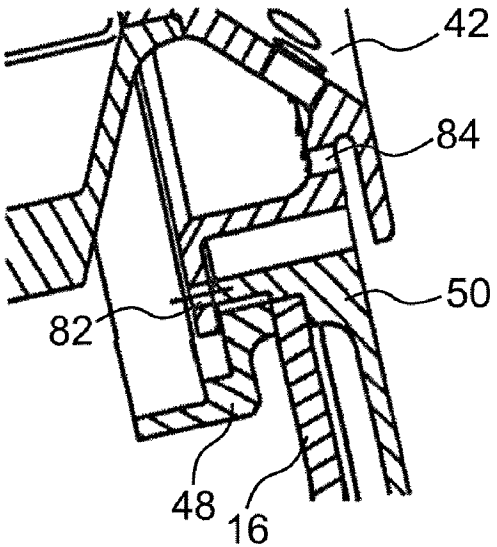

FIGS. 6 and 7 show the tongue 58 introduced into the slot 60 of the sleeve 48. The presence of ventilation holes 82 formed in the floating ring 46 can also be seen. As can be observed in FIGS. 8, 9 and 10, the function of the ventilation holes 82 is to cool the deflector 50. FIG. 8 shows the injection system in a nominal position in which it is centered with respect to the deflector; FIG. 9 shows a region in which there is a minimum clearance between the deflector and the injection system (more precisely the bowl), and FIG. 10 shows an off-centered position of the injection system with respect to the deflector 50 in which there is a maximum clearance between these two parts. In the position shown in FIGS. 8 and 9, that is to say in the centered position and in the minimum clearance position, the deflector 50 is sufficiently cooled by an air stream from the ventilation holes 84 that sweeps over it. This is the reason why, in FIGS. 8 and 9, the ventilation holes 82 in the floating ring 46 are blocked off because they are opposite the deflector 50. Therefore, in these positions, there is no ventilating air flow flowing through the ventilation holes 82. By contrast, in the position represented in FIG. 10, the ventilation holes 82 are disengaged from the deflector 50. Therefore, an air flow flows through these holes so as to cool the deflector 50.

The invention claimed is:

1. An arrangement for a jet engine combustion chamber, said chamber comprising a chamber endwall perforated by at least one circular passage hole, the arrangement comprising:

an injection system associated with said circular passage hole and mounted so that the injection system slides diametrically with respect to the circular passage hole in the chamber endwall;

a deflector mounted fixedly on the chamber endwall inside the combustion chamber, the deflector including a fitting ring which includes first tenons which are spaced circumferentially and project radially;

a sleeve which is coaxial to the fitting ring of the deflector and includes second tenons which are spaced circumferentially and project radially; and a floating ring which is slidably mounted in the sleeve, wherein the first and the second tenons are sufficiently spaced to allow passage of the first tenons between the second tenons and then, through a rotation, engagement of the first tenons behind the second tenons prohibits the deflector and the sleeve from separating in an axial direction, wherein the injection system is slidably mounted in the sleeve, wherein an antirotation means is provided to prevent a rotation of the injection system with respect to the sleeve, and wherein the floating ring is provided with a plurality of ventilation holes.

2. The arrangement as claimed in claim 1, wherein the sleeve includes a cup with an end seat on which the floating ring slides and a rim, and the floating ring is retained by a closure ring welded to the rim.

3. The arrangement as claimed in claim 1, wherein the fitting ring passes through the passage hole in the chamber endwall.

4. The arrangement as claimed in claim 1, wherein the first tenons protrude in a radially outward direction and wherein the second tenons protrude in a radially inward direction.

5. The arrangement as claimed in claim 2, wherein the antirotation means includes a tongue for the orientation of the floating ring, which tongue cooperates with a slot disposed in the rim of the sleeve.

6. The arrangement as claimed in claim 1, wherein said arrangement comprises an orientation finger which passes through the chamber endwall and which engages at a first end into a slot for the orientation of the deflector and at a second end into a slot for the orientation of the sleeve, the orientation finger imposing a defined angular orientation of the deflector and of the sleeve with respect to the chamber endwall and defines an angular orientation of the sleeve and of the deflector with respect to one another.

7. The arrangement as claimed in claim 1, wherein the ventilation holes in the floating ring are arranged opposite the deflector in a region where there is a clearance between the injection system and the deflector that is below a limit value and are disengaged from the deflector in a region where the clearance between the injection system and the deflector is above the limit value.

8. A jet engine which comprises an arrangement as claimed in claim 1.

9. A sleeve forming part of an arrangement as claimed in claim 1.

10. An injection system forming part of an arrangement as claimed in claim 1.

11. A deflector forming part of an arrangement as claimed in claim 1.

12. The arrangement according to claim 7, wherein air flows through the ventilation holes to cool the deflector when the clearance between the injection system and the deflector is above the limit value.

* * * * *